US008782824B2

(12) United States Patent
Shoop et al.

(10) Patent No.: US 8,782,824 B2
(45) Date of Patent: Jul. 22, 2014

(54) TUB DRAIN AND OVERFLOW ASSEMBLY

(75) Inventors: Douglas M. Shoop, Kirksville, MO (US); Buddy L. Ambrosia, Greentop, MO (US)

(73) Assignee: Douglas M. Shoop, Kirksville, MO (US)

( * ) Notice: Subject to any disclaimer, the term of this patent is extended or adjusted under 35 U.S.C. 154(b) by 375 days.

(21) Appl. No.: 12/428,150

(22) Filed: Apr. 22, 2009

(65) Prior Publication Data

US 2009/0260154 A1 Oct. 22, 2009

Related U.S. Application Data

(60) Provisional application No. 61/125,090, filed on Apr. 22, 2008.

(51) Int. Cl.
*E03C 1/00* (2006.01)

(52) U.S. Cl.
USPC ..... 4/671; 4/679; 4/683; 4/686; 4/539; 4/653

(58) Field of Classification Search
USPC ..... 4/679, 683, 686, 539, 541.3, 670–674, 4/653, 255.01, 255.04, 255.07, 584
See application file for complete search history.

(56) References Cited

U.S. PATENT DOCUMENTS

| | | | | | |
|---|---|---|---|---|---|
| 405,933 | A * | 6/1889 | Wells | 4/584 |
| 1,191,088 | A * | 7/1916 | Mercer | 4/594 |
| 1,427,567 | A * | 8/1922 | Yeiser | 4/674 |
| 1,994,789 | A * | 3/1935 | Redmond et al. | 4/681 |
| 2,027,371 | A * | 1/1936 | Davison | 4/211 |
| 3,827,086 | A * | 8/1974 | Seymour et al. | 52/35 |
| 3,908,208 | A * | 9/1975 | McIlroy | 4/679 |
| 4,352,213 | A | 10/1982 | Watts | |
| 4,720,877 | A | 1/1988 | Watts | |
| 4,930,164 | A * | 6/1990 | Gibson | 4/683 |
| 5,325,549 | A * | 7/1994 | Cornwall | 4/679 |
| 6,058,525 | A | 5/2000 | Paden | |
| 6,088,843 | A * | 7/2000 | Francisco | 4/289 |
| 6,192,531 | B1 | 2/2001 | Fritz et al. | |
| 6,292,958 | B1 | 9/2001 | Benne et al. | |
| 6,588,803 | B2 * | 7/2003 | Vila | 285/134.1 |
| 6,675,406 | B2 * | 1/2004 | Ball | 4/683 |
| 6,823,539 | B1 * | 11/2004 | Bantz | 4/675 |
| 7,278,178 | B2 | 10/2007 | Witzleben | |
| 2003/0000012 | A1 * | 1/2003 | Ball | 4/680 |
| 2004/0055083 | A1 * | 3/2004 | Ball | 4/680 |
| 2006/0085907 | A1 * | 4/2006 | Ball | 4/680 |

* cited by examiner

*Primary Examiner* — Jason Boeckmann
*Assistant Examiner* — Joel Zhou
(74) *Attorney, Agent, or Firm* — Greer, Burns & Crain, Ltd.

(57) ABSTRACT

The invention provides a drain and overflow assembly for a tub having a drain opening and a overflow opening, including a main drainage pipe, a drain fitting having a drain inlet end configured to be connected to the drain opening and a drain outlet end configured to be connected to the main drainage pipe, a trap, an overflow receiving hub disposed between the trap and the drain inlet end, and a multi-purpose fitting including an overflow path having an overflow inlet end configured to be connected to the multi-purpose opening and an overflow outlet end configured to be connected to the overflow receiving hub, the multi-purpose fitting further including a cleanout path having a cleanout inlet end configured to be connected to the multi-purpose opening and a cleanout pipe end configured to be connected to the main drainage pipe.

17 Claims, 6 Drawing Sheets

TUB DRAIN AND OVERFLOW ASSEMBLY

PRIORITY CLAIM AND REFERENCE TO RELATED APPLICATION

The application claims priority under 35 U.S.C. §119 from prior provisional application Ser. No. 61/125,090, which was filed Apr. 22, 2008.

FIELD

The field of the invention is pipe assemblies used for plumbing purposes. Example applications of the invention include pipe assemblies implementing plumbing systems for showers and bathtubs.

BACKGROUND

As shown in FIG. 1, a traditional plumbing system 10 for showers and bathtubs includes a drain pipe 12 that connects a drain opening 14 in a tub or basin 16 to a main drainage pipe 18, allowing water to drain from the tub to an external destination. In addition, many plumbing systems have an overflow pipe 20 that prevents the water level from reaching a certain height (typically, just below the height of the tub). The overflow pipe 20 is designed in a similar fashion, connecting an overflow opening 22 to the main drainage pipe 18. The main drainage pipe may extend above and below the tub or basin 16 as shown (which, might be typical in a multi-floor plumbing system) or might only extend to slightly below the drain pipe 12.

When the drain pipe 12 or the overflow pipe 20 is connected to the main drainage pipe 18, there exists an opportunity for sewer gas to travel back though the main drainage pipe and out of the openings 14, 22 through which the water is normally drained. A trap assembly 24 is commonly used to prevent such movement of gas. A trap is a "U", "S", or "J"-shaped configuration in the pipe or fixture that, due to its shape, retains a small amount of water after water moves through it as it is drained. This retained water provides a seal that prevents sewer gas from passing back into the area around the tub 16.

Rather than having a separate trap assembly 24 for both the drain pipe 12 and the overflow pipe 20, the two pipes traditionally converge into a single pipe 26, which runs to the trap assembly 24, thus preventing gas from moving back through either the drain opening 14 or the overflow opening 22.

A common issue with plumbing systems is that the pipes collect dirt, bacteria, and other drain build-up over time. One method of cleaning pipes in these systems is to use a cleaning cable or tape. A cleaning cable or tape is pushed through the pipe and acts in a snake-like manner to traverse the pipe, while pushing along the edges of the pipe to remove unwanted material. While cables are designed to be flexible and to follow turns and the like in the pipe's path, sharp changes in direction (i.e., the trap assembly 24) are difficult for a cable to move through. Further, even if a cable or tape makes it through the trap assembly 24, it is nearly impossible to pull the cable or tape back through the trap assembly without being damaged. As such, it is extremely difficult to effectively clean the main drainage pipe 18. Notably, in some plumbing systems (e.g., a kitchen sink), the trap is easily accessible and can therefore be temporarily removed such that a cable or tape can bypass the trap and be fed directly to the main drainage pipe. However, in plumbing systems for showers and bathtubs, the trap is often beneath the tub or floor. Therefore, it is difficult to temporarily remove the trap in such systems.

SUMMARY OF THE INVENTION

The invention provides a drain and overflow assembly for a tub having a drain opening and a multi-purpose opening, including a main drainage pipe, a drain fitting, and a multi-purpose fitting. The drain fitting includes a drain inlet end configured to be connected to the drain opening and a drain outlet end configured to be connected to the main drainage pipe. The drain fitting further includes a trap and an overflow receiving hub disposed between the trap and the drain inlet end. The multi-purpose fitting includes an overflow path having an overflow inlet end configured to be connected to the overflow opening and an overflow outlet end configured to be connected to the overflow receiving hub. The multi-purpose fitting further includes a cleanout path having a cleanout inlet end configured to be connected to the overflow opening and a cleanout pipe end configured to be connected to the main drainage pipe.

The invention also provides a drain and overflow assembly for a plumbing system having a drain opening, an overflow opening, and a main drainage pipe. The assembly includes a unitary multi-purpose fitting providing an overflow path to a trap and a cleanout path to a main drainage pipe. The drain and overflow assembly further includes an overflow inlet end to the overflow path and a cleanout inlet end to the cleanout path, the separate overflow and cleanout inlet ends being presented in an overflow opening dimensioned to connect to a standard tub or basin overflow opening. A conduit connects the overflow path to a drain path provided by a drain fitting.

The invention provides for easier and more efficient cleaning of pipes. In particular, the invention allows a cleaning cable or tape to be passed through to the main drainage pipe for cleaning without having to traverse or temporarily remove a trap.

DETAILED DESCRIPTION OF THE PREFERRED EMBODIMENTS

Figure 1:
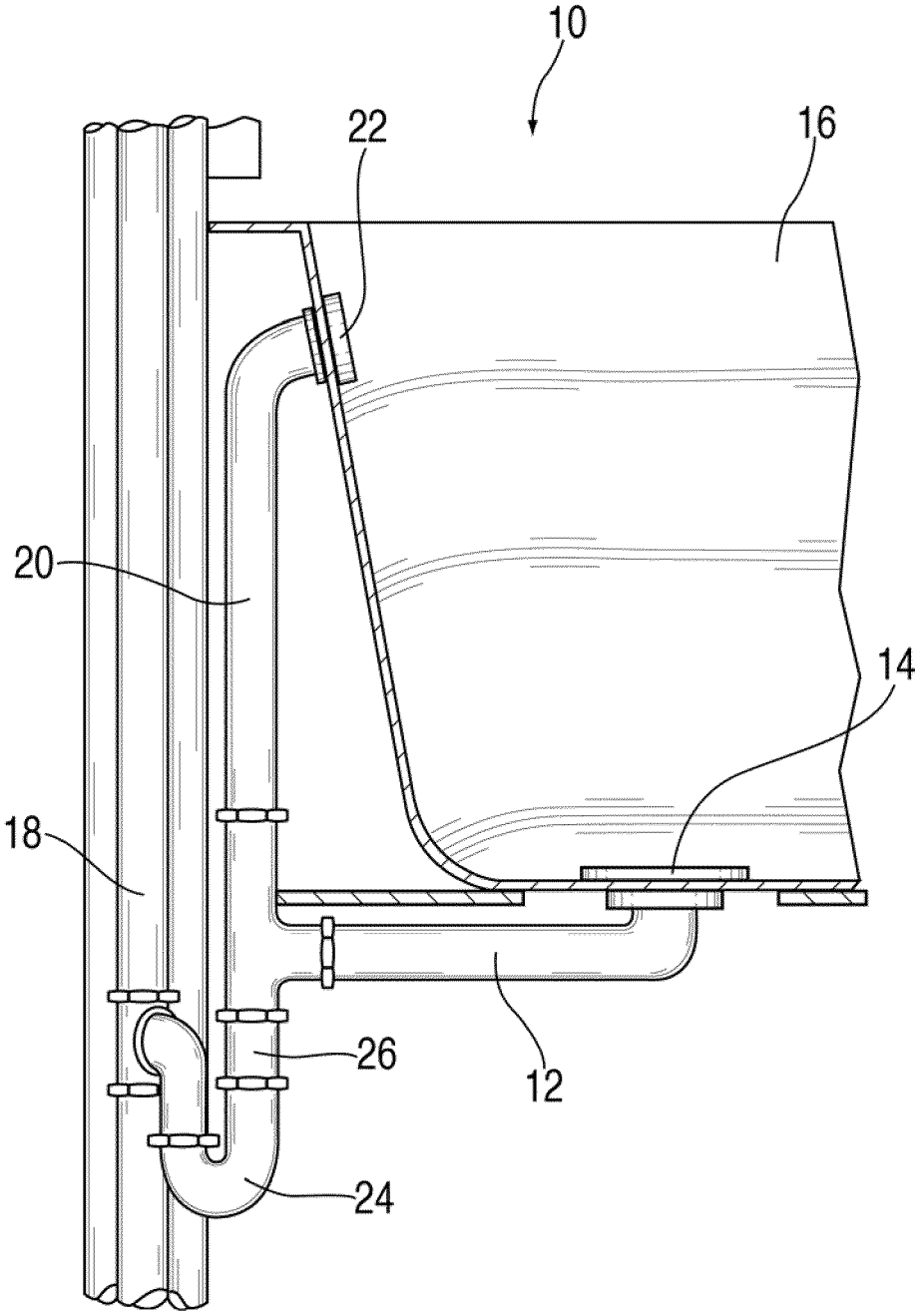
FIG. 1 PRIOR ART
FIG. 1 is a schematic cross-sectional side view of a prior art pipe assembly.

The invention provides a drain and overflow assembly for a plumbing system having a drain opening, an overflow opening, and a main drainage pipe. The assembly includes a unitary multi-purpose fitting providing an overflow path to a trap and a cleanout path to a main drainage pipe. The drain and overflow assembly further includes an overflow inlet end to the overflow path and a cleanout inlet end to the cleanout path, the separate overflow and cleanout inlet ends being presented in an overflow opening dimensioned to connect to a standard tub or basin overflow opening. A conduit connects the overflow path to a drain path provided by a drain fitting.

As such, in the present drain and overflow assembly, the overflow opening in the tub connects not only to an overflow path for draining excess water as in traditional plumbing systems, but also to a second cleanout path having direct access to the main drainage pipe (i.e., a path that does not include a trap). This allows a cleaning cable or tape to be easily passed into the main drainage pipe through the cleanout path for cleaning. The assembly still provides a path to a trap for main drainage and overflow.

Since the overflow and cleanout inlet ends are presented in an overflow opening dimensioned to connect to a standard tub or basin overflow opening, the present drain and overflow assembly can be retrofitted into standard tubs or basins. As such, the present drain and overflow assembly may be sold separately (e.g., as part of an installation kit) and installed on an existing tub or basin. However, it is also contemplated that the present drain and overflow assembly will be sold for use with new tub or basin installations.

Preferred embodiments of the invention will now be discussed with respect to the drawings. The drawings may include schematic representations, which will be understood by artisans in view of the general knowledge in the art and the description that follows. Features may be exaggerated in the drawings for emphasis, and features may not be to scale.

Figure 2:
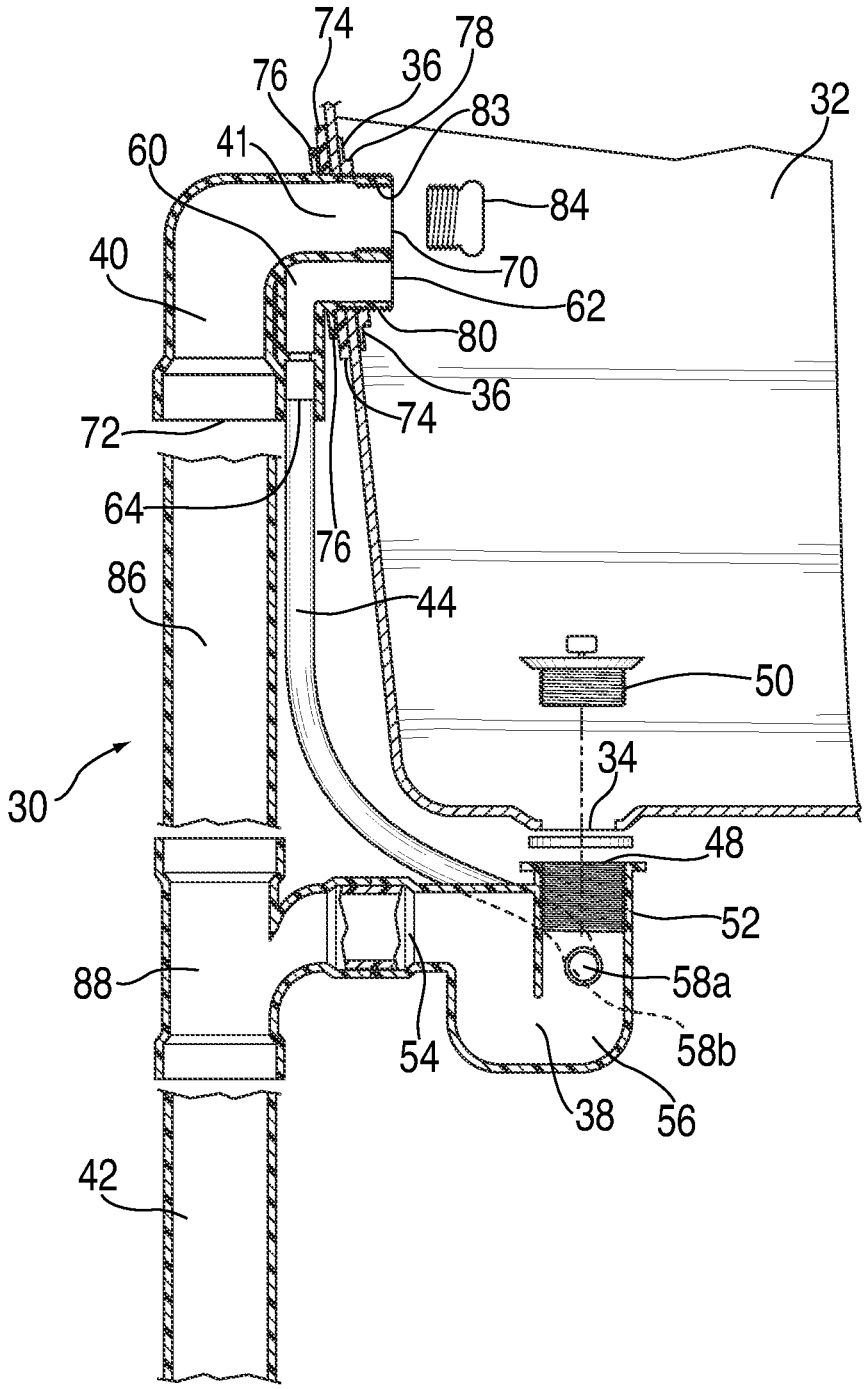
FIG. 2 is a schematic exploded cross-sectional side view of a preferred embodiment drain and overflow assembly of the invention.

Referring now to FIG. 2, a preferred embodiment drain and overflow assembly 30 is shown installed in a tub or basin 32 having a drain opening 34 and a standard sized overflow opening 36, which accepts overflow when the basin or tub 32 reaches a predetermined fill level. The drain and overflow assembly 30 includes a unitary drain fitting 38 that normally accepts drainage from the tub or basin 32. The assembly 30 of the invention also includes a unitary multi-purpose fitting 40 that is sized according to the standard sized overflow opening 36 but provides both a direct cleanout path 41 to a main drainage pipe 42, and a path through an overflow conduit 44 to the drain fitting 38. The overflow conduit 44 can be a flexible tube, for example a plastic tube, or a pipe that is shaped to avoid interference with the tub or basin 16.

Figure 3:
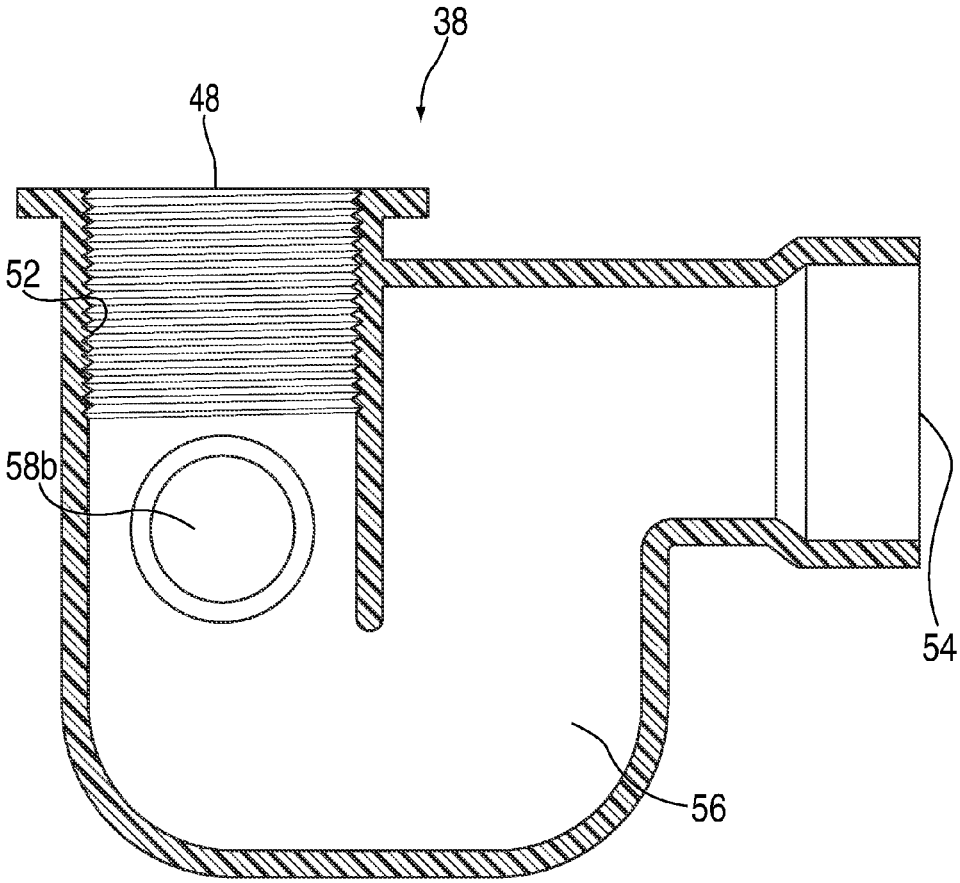
FIG. 3 is a schematic cross-sectional side view of a drain fitting of the pipe assembly of FIG. 2.
Figure 4:
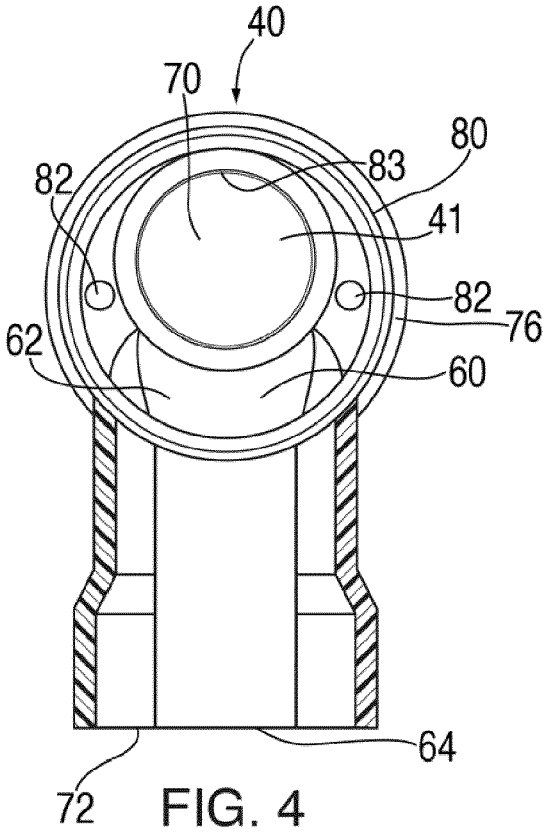
FIG. 4 is a schematic cross-sectional front view of a multi-purpose fitting of the pipe assembly of FIG. 2.
Figure 5:
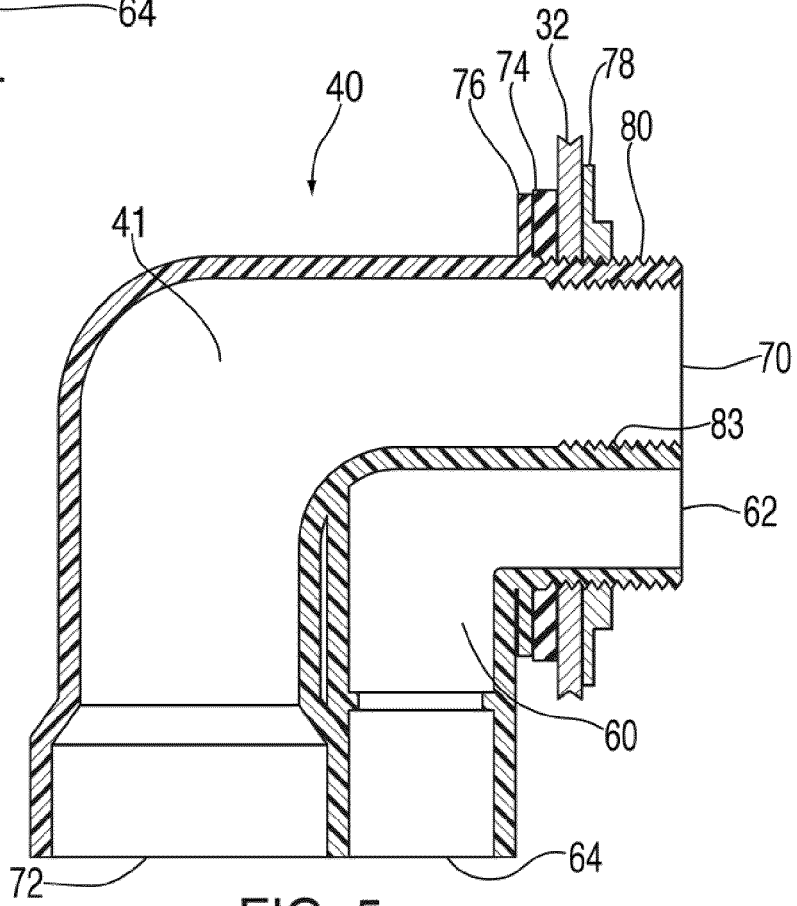
FIG. 5 is a schematic cross-sectional side view of the multi-purpose fitting of FIG. 4.
Figure 6:
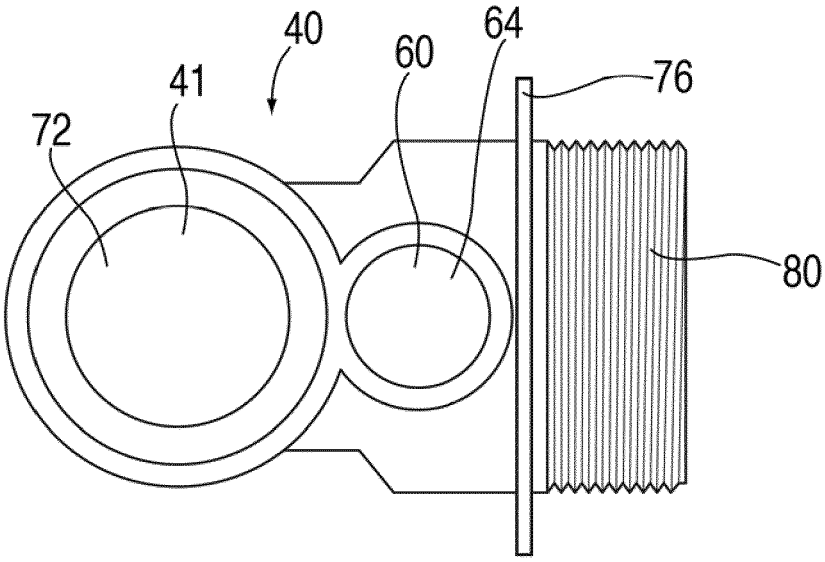
FIG. 6 is a schematic cross-sectional bottom view of the multi-purpose fitting of FIG. 4.

Referring now to FIGS. 2 and 3, a drain inlet end 48 on the drain fitting 38 is configured to connect to the drain opening 34 to receive water draining out of the tub or basin 32. A removable drain closure 50 engages grooves 52 disposed on the drain fitting 38 for controlling drain water. Preferably, a "hand-and-foot" operated drain closure is used as known in the art, which has an open and a closed position. When the drain closure 50 is in the closed position, it prevents water from draining from the tub or basin 32. A drain outlet end 54 on the drain fitting 38 is configured to connect to the main drainage pipe 42 such that when the drain closure 50 is in the open position, drain water flows though the drain fitting 38 to the main drainage pipe 42. The drain fitting 38 is also configured and arranged to form a trap 56 between the drain inlet end 48 and the drain outlet end 54. Therefore, water drains from the tub or basin 32, through the drain fitting 38 (and through the trap 56), and into the main drainage pipe 42. The trap 56 prevents gas from moving back through the drain opening 34 and into the area around tub or basin 32. At least one and preferably two overflow receiving hubs 58 (shown as 58*a* and 58*b*) are disposed on the drain fitting 38 for receiving overflow water from the multi-purpose fitting 40 using the overflow conduit 44.

Referring now to FIGS. 2 and 4-6, when the water level in the tub or basin 32 reaches the height of the overflow opening 36, the water flows though an overflow inlet end 62, which is configured to connect to the overflow opening 36. The overflow water then flows though an overflow path 60 to an overflow outlet end 64, which is configured to connect to the overflow receiving hubs 58 using the overflow conduit 44. Preferably, the overflow conduit 44 is a flexible ¾" or 1" diameter PVC pipe such that it can be easily moved to connect to either of the overflow receiving hubs 58. Use of the overflow path 60 is selective, such as by removing a knock-out piece, a threaded plug or the like to open the path. As such, the multi-purpose fitting 40 can still be used in an installation even if there is no desire to handle overflow water.

The overflow receiving hubs 58 preferably project about 1" from the drain fitting 38 and similarly can be selectively opened, such as by removing a knock-out piece, a threaded plug or the like, resulting in either of the two paths being opened. This allows an installer to easily select a path that can be most easily implemented given any space or mobility restraints. The overflow receiving hubs 58 are preferably positioned between the drain inlet end 48 and the trap 56 such that overflow water must pass through the trap 56 before reaching the main drainage pipe 42. Thus, as with the drain opening 34, sewer gas is prevented from passing from the main drainage pipe 42 back through the overflow opening 36 and into an area around the tub or basin 32.

The cleanout path 41 in the multi-purpose fitting 40 provides direct access to the main drainage pipe 42. Such access allows for an easy and effective cleaning solution, unlike in a traditional plumbing system (which includes the trap obstacle). When cleaning the main drainage pipe 42, a cleaning cable or tape is fed through a cleanout inlet end 70 configured to connect to the overflow opening 36, then though the cleanout path 41, and finally though a cleanout pipe end 72 configured to connect to the main drainage pipe 42.

The overflow inlet end 62 of the overflow path 60 and the cleanout inlet end 70 of the cleanout path 41 are positioned adjacent to each other such that they can communally engage the overflow opening 36 in the tub or basin 32. The overflow inlet end 62 and cleanout inlet end 70 are preferably of a size and arrangement such that they will engage a standard size overflow opening, thereby allowing the drain and overflow assembly 30 to be retrofitted into an existing tub or basin 32. To seal and secure the multi-purpose fitting 40 to the tub or basin 32, a gasket 74 is positioned between the tub or basin 32 and a flange 76 preferably extending ½" from the multi-purpose fitting 40. A threaded retaining nut 78 engages grooves 80 on the multi-purpose fitting 40 and is tightened to maintain a seal between the multi-purpose fitting 40 and the tub or basin 32 using the gasket 74 (note that for clarity, the retaining nut 78, tub 32, and gasket 74 are not shown in FIG. 4). Preferably, the gasket 74 is made of rubber or elastomeric foam and the retaining nut 78 is made of metal although other suitable materials are contemplated.

Preferably, the cleanout inlet end 70 is generally circular-shaped and includes grooves 83 adjacent to the cleanout inlet end 70, which are configured to accept a sealingly engaging threaded plug 84 (FIG. 1). The threaded plug 84 is used when the pipes are not being cleaned, thereby preventing sewer gas from entering the area around the tub or basin 32. Further, although the plug 84 is inserted through the overflow opening 36, the plug only seals the cleanout path 41 and therefore leaves the overflow path 60 unsealed to provide constant drainage of overflow water.

Figure 7:
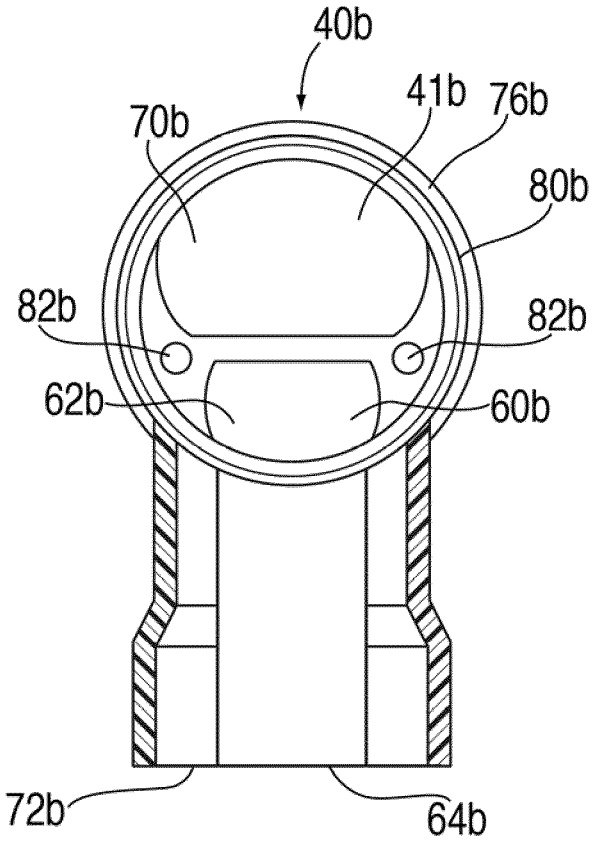
FIG. 7 is a schematic cross sectional front view of a multi-purpose fitting portion of another preferred embodiment drain and overflow assembly of the invention.
Figure 8:
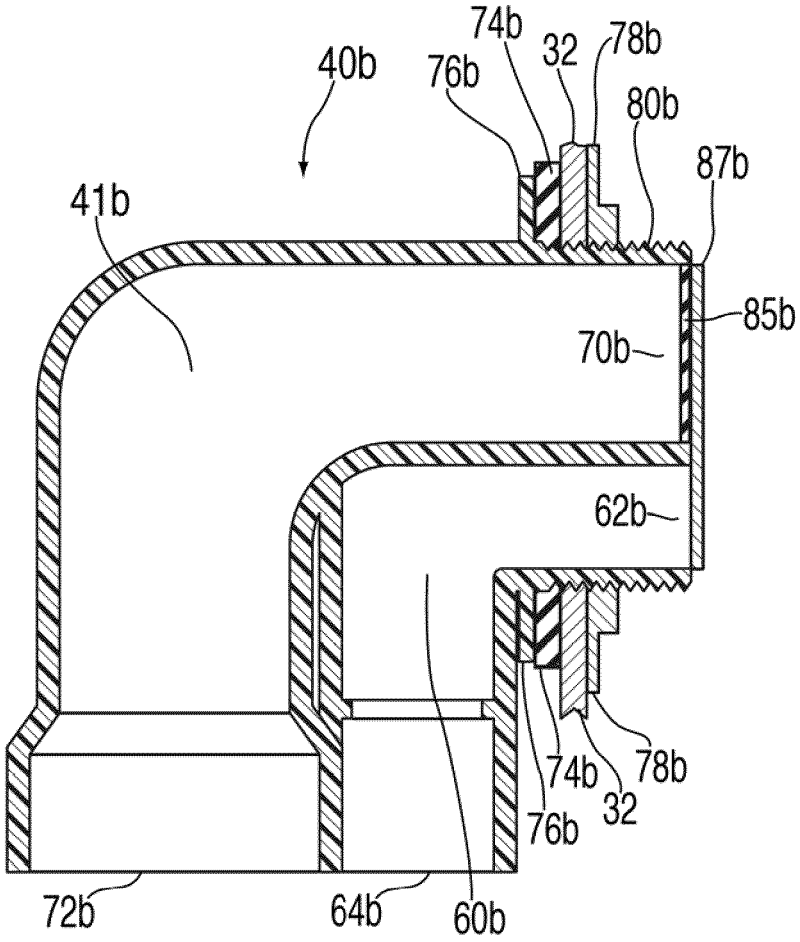
FIG. 8 is a schematic cross sectional side view of the multi-purpose fitting of FIG. 7.

Referring now to FIGS. 7-8, in an alternate embodiment, the drain and overflow assembly 30 includes a varied multi-purpose fitting 40*b*. Instead of using the threaded plug 84 as with the preferred embodiment, a gasket 85*b* extending from a cover plate 87*b* is configured to maintain a seal around a cleaning inlet end 70*b* of the multi-purpose fitting 40*b*. The cover plate 87*b* is affixed to the inlet ends 62*b*, 70*b* of the multi-purpose fitting 40*b* by using fasteners to engage openings 82*b*. By forgoing use of a threaded plug, the cleanout path 41*b* need not be circular, and can therefore have a variety of shapes. See for example FIG. 7 showing a generally oval-shaped cleanout path 41*b* (note that for clarity, the retaining nut 78 and tub 32 are not shown in FIG. 7). This allows for custom sizes and configurations of both the overflow path 60*b* and cleanout path 41*b* with the gasket 85*b* and cover plate 87*b* being configured and sized accordingly.

Since the drain fitting 38 and the multi-purpose fitting 40 both connect to the main drainage pipe 42, a pipe extension 86 and a generally "Y" or "T"-shaped tee fitting 88 are configured and preferably included with the drain and overflow assembly 30 to provide such a union (FIG. 2). It is noted that all connections described herein (e.g., connections between assemblies and between inlets and openings) are made using conventional equipment. For example, industry standard Schedule 40 PVC or ABS pipes are used to connect the assemblies, while rubber gaskets or the like are used to ensure watertight seals where necessary. Unless otherwise noted, all pipes and assemblies disclosed preferably have a generally cylindrical body with an approximate diameter of 1.5". However, other sizes can also be used (e.g., shower installations would typically use pipes with a 2" diameter). Further, such pipes and assemblies can be constructed and arranged (i.e., formed with various angles) and additional fixtures can be used to accommodate particular environmental configurations and restraints. Therefore, the invention is not limited to the specific configurations show in the accompanying figures.

Further, while the present drain and overflow assembly 30 has been described as being installed in a plumbing system for showers and bathtubs with a tub or basin, application of the assembly 30 is not so limited. Indeed, the assembly 30 can be installed in a typical shower stall without a tub or basin (which therefore would include a drain opening, but not an overflow opening). Installation of the assembly 30 in such a stall is achieved by first creating an overflow opening in a wall of the shower stall and then installing the assembly 30 in the same similar fashion as that described above with respect to the tub or basin 32. Another example application of the assembly is an installation into a sink. While residential sinks traditionally have an overflow system build into the sink, other types (e.g., commercial sinks) are often designed similar to the traditional tubs or basins described above (i.e., they have a similarly positioned overflow openings and drain openings). As such, the present assembly 30 can also be installed in select types of accommodating sinks.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A drain and overflow assembly for a plumbing system having a main drainage pipe and a tub or basin including both a drain opening and an overflow opening, comprising:

a drain fitting having a drain inlet end configured to be connected to the drain opening and a drain outlet end configured to be connected to the main drainage pipe, said drain fitting including a trap between, and at least two overflow receiving hubs disposed between said trap and said drain inlet end; and a multi-purpose fitting including an overflow path having an overflow inlet end configured and dimensioned to be connected to the overflow opening and an overflow outlet end configured to be connected to one or more of said at least two overflow receiving hubs, said multi-purpose fitting further including a separate cleanout path having a cleanout inlet end configured to be connected to the overflow opening and a cleanout pipe end configured to be connected to the main drainage pipe, wherein said multi-purpose fitting is configured for receiving one of a plug or a gasket which seals only the cleanout path from the tub or basin at the cleanout inlet end, leaving the overflow path unsealed.

2. The drain and overflow assembly of claim 1 wherein the overflow opening is standard tub or basin overflow opening.

3. The drain and overflow assembly of claim 1 wherein said multi-purpose fitting further comprises:

grooves disposed on said cleanout path and adjacent to said cleanout inlet end; and said plug configured for engaging said grooves and sealingly engaging said cleanout path.

4. The drain and overflow assembly of claim 1 further comprising:

a gasket configured for maintaining a seal around the cleaning inlet end.

5. The drain and overflow assembly of claim 4 further comprising:

a cover plate configured for maintaining a position of said gasket.

6. The drain and overflow assembly of claim 1 further comprising an overflow conduit connecting said overflow outlet end to said one or more of said at least two overflow receiving hubs.

7. The drain and overflow assembly of claim 6, wherein said overflow conduit is flexible.

8. The drain and overflow assembly of claim 1 further comprising:

a tee fixture configured for connecting said drain fitting and said multi-purpose fitting to said main drainage pipe.

9. The drain and overflow assembly of claim 1, further comprising knock-outs for each of said at least two overflow receiving hubs.

10. The drain and overflow assembly of claim 1 further comprising a knock-out associated with said overflow path.

11. A drain and overflow assembly for a tub or basin having a drain opening and an overflow opening, the assembly comprising a unitary multi-purpose fitting providing an overflow path to a trap and a direct cleanout path having a cleanout inlet end configured to be in direct communication with a cleanout pipe end that is directly attached to a main drainage pipe and thereby create a bypass of the trap, an overflow inlet end to the overflow path and said cleanout inlet end to the cleanout path, the separate overflow and cleanout inlet ends being presented in the overflow opening are dimensioned to connect to a standard tub or basin overflow opening, the unitary multi-purpose fitting being configured and dimensioned to fit the standard tub or basin overflow opening and divide it by presenting the overflow and cleanout inlet ends adjacent each other in the overflow opening, wherein said multi-purpose fitting is configured for receiving one of a plug or a gasket which seals only the cleanout path from the tub or basin at the cleanout inlet end, leaving the overflow path unsealed.

12. The drain and overflow assembly of claim 11 further comprising:

a drain fitting providing a drain path; and a conduit connecting the overflow path to the drain path.

13. The drain and overflow assembly of claim 11, further comprising a trap downstream of the overflow path.

14. The drain and overflow assembly of claim 12, wherein said conduit comprises a flexible tube.

15. The drain and overflow assembly of claim 11, wherein said plug or gasket seals the cleanout inlet end without blocking the overflow inlet end.

16. A drain and overflow assembly for a plumbing system having a main drainage pipe and a tub or basin including both a drain opening, a trap between the drain opening and the main drainage pipe, and an overflow opening above the drain opening in fluid communication with the trap, comprising:

a unitary multi-purpose fitting dimensioned to connect to the overflow opening, the unitary multi-purpose fitting defining adjacent overflow and cleanout inlets, the unitary multi-purpose fitting being configured and dimensioned to fit into and divide the overflow opening, the cleanout inlet defining a cleanout path within the unitary multi-purpose fitting configured to be connected directly to the main drainage pipe and create a bypass of the trap, the overflow inlet defining separate overflow path within the unitary multi-purpose fitting and having an overflow outlet;

a flexible tube connected to the overflow outlet, the flexible tube being dimensioned and configured to connected to the trap;

wherein the cleanout inlet is configured for receiving one of a plug or a gasket which seals only the cleanout path, leaving said overflow path unsealed, wherein said unitary multi-purpose fitting is divided throughout its length to define the clean out path and the separate overflow path.

17. The drain and overflow assembly of claim 16, wherein the trap has an opening that connects to the flexible tube.

* * * * *